United States Patent [19]

Milks

[11] Patent Number: 4,633,769

[45] Date of Patent: Jan. 6, 1987

[54] ROOF VENT FAN ASSEMBLY

[76] Inventor: Stephen A. Milks, 4431 Bridgeman Trail, Swartz Creek, Mich. 48473

[21] Appl. No.: 787,200

[22] Filed: Oct. 15, 1985

[51] Int. Cl.[4] ..... F24F 7/02

[52] U.S. Cl. ..... 98/42.08; 98/2.14; 98/116

[58] Field of Search ..... 98/2.14, 42.04, 42.07, 98/42.08, 42.09, 116

[56] References Cited

U.S. PATENT DOCUMENTS

| | | | |
|---|---|---|---|
| 1,722,825 | 7/1929 | Roethel . | |
| 1,983,979 | 12/1934 | Graham | 98/2.14 |
| 2,103,843 | 12/1937 | Filion | 98/2 |
| 2,665,625 | 1/1954 | Woodhams | 98/42.09 X |
| 2,733,649 | 2/1956 | LeBarron | 98/1 |
| 2,752,843 | 7/1956 | Strawsine | 98/116 |
| 3,472,150 | 10/1969 | Strawsine | 98/42.09 X |
| 3,479,947 | 11/1969 | Myers | 98/116 |
| 3,867,486 | 2/1975 | Hagele | 98/2.14 X |
| 3,895,568 | 7/1975 | Stone | 98/42.09 |
| 3,934,383 | 1/1976 | Perry et al. | 98/2.14 X |
| 4,062,273 | 12/1977 | O'Connor | 98/8 |

*Primary Examiner*—Harold Joyce

*Attorney, Agent, or Firm*—Cullen, Sloman, Cantor, Grauer, Scott & Rutherford

[57] ABSTRACT

A power roof vent fan assembly having a motor and fan mounted in a body spanning an opening in the roof of an enclosure. The motor is mounted in H-shaped cross brace assembly having reinforcing ribs for vibration dampening. A shroud is secured to the body which supports a screen and includes a trim flange which forms a pocket in conjunction with the body. A bezel is telescopically received within the pocket and secured to the lower surface of the roof. A cover is provided over the top end of the assembly which is hinged on one end and adapted to be opened and closed by a cover lifting mechanism located within the pocket. The fan motor is controlled by a speed control switch also located within the pocket. The pocket in which the switch is retained includes ventilation openings for aiding heat dissipation from the switch.

8 Claims, 4 Drawing Figures

ROOF VENT FAN ASSEMBLY

BACKGROUND OF THE INVENTION

1. Technical Field

The present invention relates generally to roof vents for enclosures and more specifically to roof exhaust vent fan assemblies having an electrically powered fan and a hinged cover.

2. Background Art

Roof vent fan devices are known to be used in vehicles as shown in U.S. Pat. No. 1,722,825 to Roethel and U.S. Pat. No. 1,983,979 to Graham and in buildings as disclosed in U.S. Pat. No. 3,479,947 to Myers. The purpose of such prior devices is to exhaust air for cooling and maintaining fresh air in the enclosures. A common disadvantage of prior roof vent fan devices when used in vehicles such as recreational vehicles, motor homes, trucks, vans, tractor cabs, boats and other enclosures having a relatively low ceiling is that they protrude below the ceiling and reduce available head room. This is especially true if the roof is thin in cross-section. In prior devices, wound electrical motors resulted in vent fan devices being substantially greater in vertical cross-section, or thickness, than the roof to which they were assembled, sometimes as much as three times the thickness of the roof in which the devices are installed.

Most vent fan devices have a single speed and are controlled by a simple on/off switch. Multi-speed switches provided for vent fan devices are generally parallel resistance motor speed control switches having one or more resistors which create heat that must be dissipated to prevent melting or deforming the vent fan body near the switch. Previously such switches were installed in the vent fan body below the fan blade in the primary air flow path to achieve the desired heat dissipation. In such vent fan devices the length of the fan housing required to enclose the motor was adequate to receive the switch without adding to the cross-sectional thickness of the device.

These and other problems and disadvantages are overcome by the present invention as summarized below.

BRIEF SUMMARY OF THE INVENTION

In one aspect of the present invention, a roof vent fan assembly for recreational vehicles, motor homes and enclosures is comprised of four primary structural components, a body including a motor mounting means and means for mounting the assembly on the roof of an enclosure, a shroud adapted to be attached to the body for enclosing an area about the fan and retaining a screen in the air flow path of the fan, a bezel having a ceiling flange adapted to be attached to the ceiling of the enclosure and a telescoping flange telescopically received in a pocket formed between the shroud and the body and a cover hingedly connected to the body. A compact disc motor and fan plate assembly are mounted in the body along with a switch for controlling the motor operation. The use of a compact disc motor in the roof vent fan assemblies of the present invention permits the assemblies to be of a reduced thickness and also enables the assemblies to be flush mounted or recess mounted in the ceiling.

According to another aspect of the present invention, a vent fan assembly features a first means for supporting a motor and fan blade over an opening in an enclosure, and a shroud defining a cylindrical air flow conduit disposed about the periphery of the fan blade and being attached to the said first means between the motor and the opening in the enclosure. A multi-speed switch is substantially enclosed within a pocket formed between the shroud and said first means, said multi-speed switch having resistor coils adapted to be selectively connected to the motor circuit for diverting current from the motor and thereby providing a multiple speed vent fan assembly. The pocket including the switch means features openings for air flow about the resistors to prevent excessive heating of the vent fan assembly which is preferably formed of molded reinforced plastic.

These and other advantages and features of the present invention will be apparent in view of the attached drawings as described in the following detailed description of one embodiment of the present invention.

DETAILED DESCRIPTION OF THE ILLUSTRATED EMBODIMENT

Figure 1:
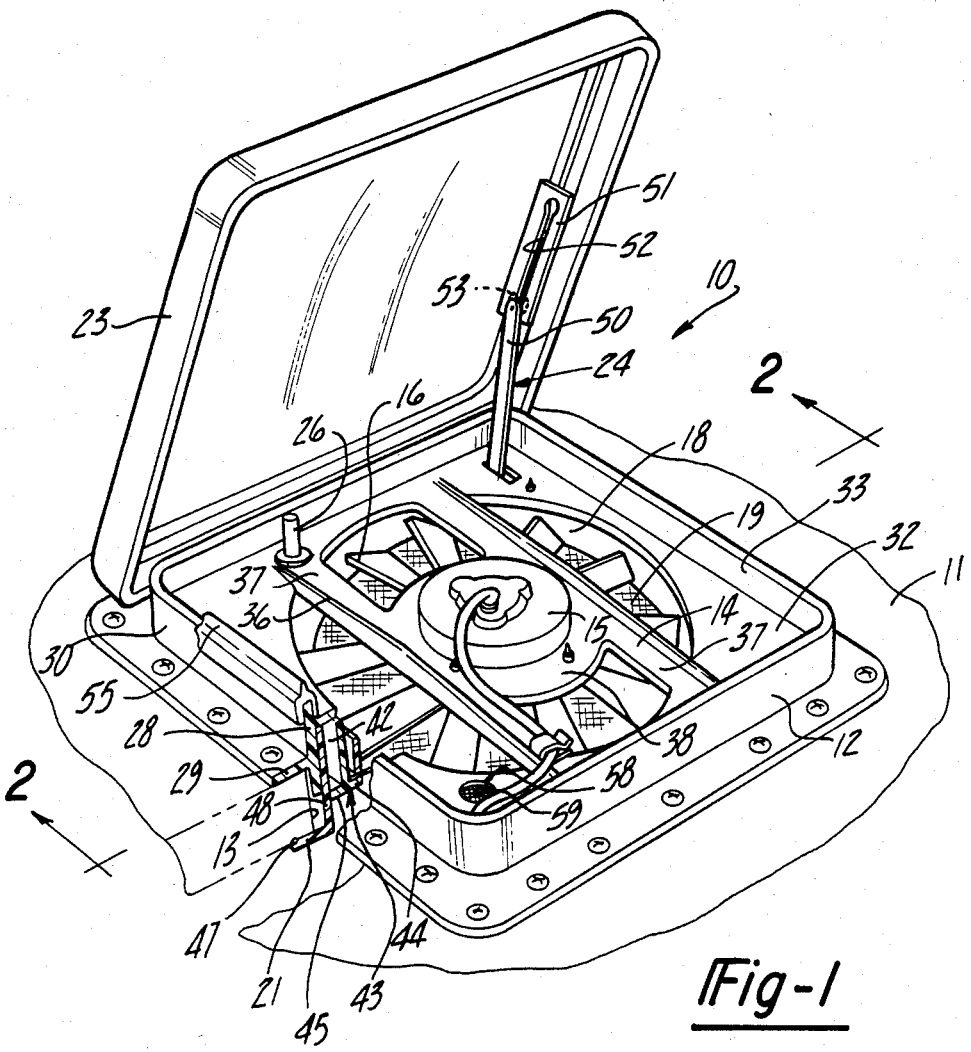
FIG. 1 is a perspective view of the illustrated embodiment of the roof vent fan assembly with the cover in its open position and a portion of the assembly being broken away to show the interrelation of the parts of the assembly.
Figure 2:
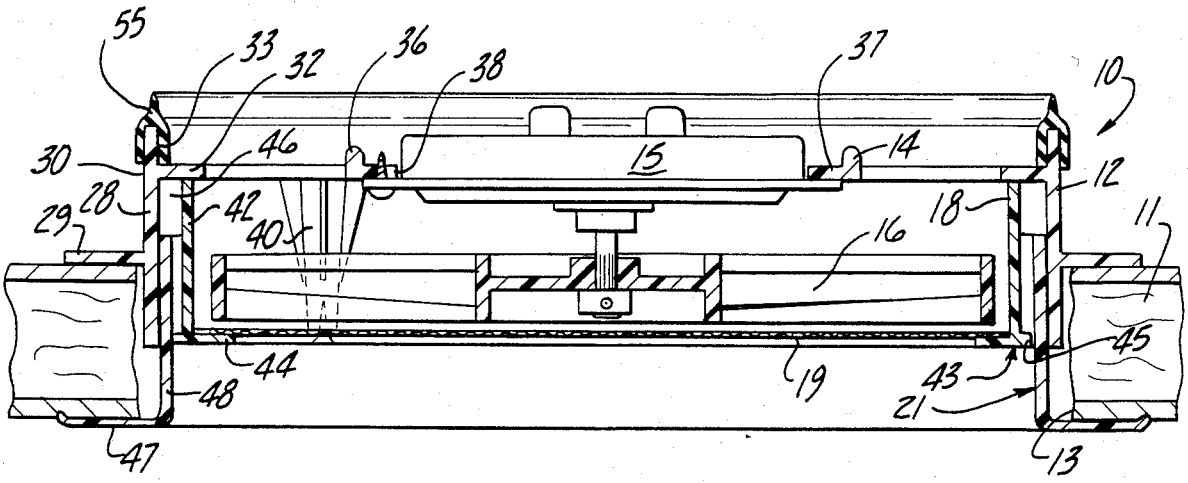
FIG. 2 is a cross-sectional view of the illustrated embodiment of the invention taken along the line 2—2 in FIG. 1.

Referring now to FIGS. 1 and 2, the vent fan assembly 10 is shown as it is attached to the roof 11 of an enclosure. The vent fan assembly 10 includes a body 12 adapted to be attached to the roof 11 and having a motor mount 14 disposed over a circular opening 13 within which a disc motor 15 and fan blade 16 are mounted. The motor 15 is preferably of the disc type as disclosed in U.S. Pat. No. 3,144,574, the disclosure of which is incorporated herein by reference. The fan blade 16 in the illustrated embodiment is a one-piece molded plastic, axial impeller fan blade.

A shroud 18 is attached to the body 12 to provide a cylindrical protective cavity for the fan blade 16 and motor 15. The shroud 18 also contains a screen 19 which prevents entry of insects into the enclosure.

A bezel 21 mounts flush to the ceiling of the enclosure on one end and is received telescopically on its other end between the shroud 18 and the body 12.

Figure 4:
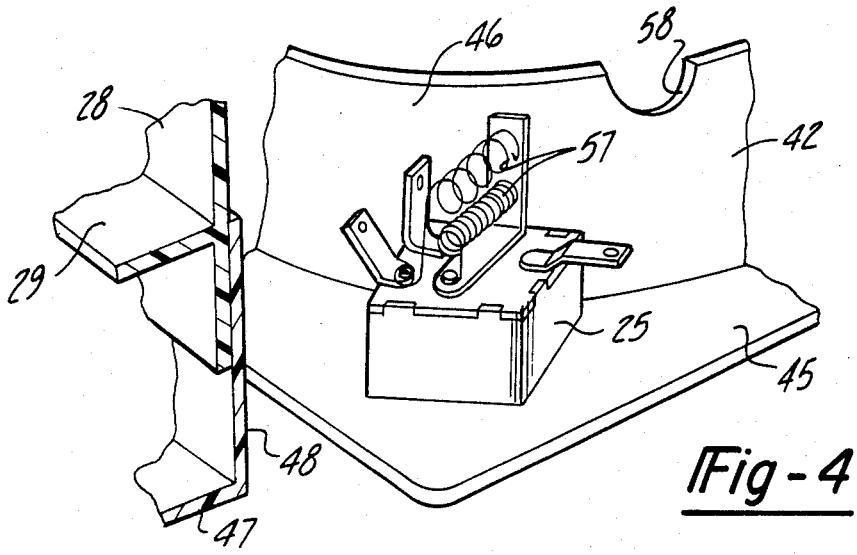
FIG. 4 is a fragmentary cross-sectional view taken along the line 4—4 in FIG. 3 and showing the multiple speed control switch as it is mounted on the shroud of the vent assembly.

A cover 23 is hingedly connected to the body 12 and is operated by means of a cover lifting means 24 which is used to pivot the cover toward and away from the body and hold the cover 23 in a desired position relative to the body 12. Referring now to FIG. 4, a switch 25 is substantially housed within a pocket defined by the shroud 18 and body 12 and preferably includes means for varying the speed of operation of the motor 15. A cover closed switch 26 is preferably provided on the body 12 at a location enclosed by the cover 23 which prevents operation of the motor 15 when the cover is closed.

The body 12, as shown in FIGS. 1 and 2, includes upstanding sidewalls 28 which extend substantially perpendicular to the roof 11 and form a closed substantially polygonal shape which in the illustrated embodiment is square with rounded corners. A roof support flange 29 extends outwardly from the outer perimeter 30 of the sidewalls 28 and is adapted to be secured to the roof by means of fasteners. A sealant is applied between the roof 11 and the roof support flange 29. A silicone sealant may also be applied to the fasteners after installation to assure a proper seal between the assembly 10 and the roof 11.

The body 12 includes a motor mount flange 32 which extends substantially parallel to the roof 11 from the inner side 33 of the sidewalls 28 and defining the circular opening 13. The motor mount flange 32 located above the roof support flange 29 so that the motor may be mounted above roof level and the fan blade 16 can be recessed above the lower surface of the roof.

The vent fan assembly of the present invention is unique in that it requires significantly less vertical cross-sectional space due to its use of a disc-type electric motor instead of a wound type of electric motor. The motor and fan blade require less than 2½ inches of vertical space and yet can develop 942 cubic feet per minute of air flow with a fan diameter of twelve inches. The motor mount flange 32 includes an integrally formed motor mount 14 in the form of an H-shaped cross brace which traverses the opening 13. The motor mount 14 features reinforcing ribs 36 extending along two parallel legs 37 and across the opening 13 to provide added strength and vibration dampening. An attachment ring 38 for mounting the motor 15 is disposed between the two parallel legs 37 of the motor mount 14. The motor 15 is attached to the attachment ring 38 by fasteners as is well known in the art.

The body 12 preferably includes integrally molded spacer posts 40 to which the shroud 18 is secured and which hold the shroud in spaced relation relative to the body 12.

The shroud 18 features a cylindrical wall 42 which extends from the body 12 at its top end to a base plate 43 at its lower end. The base plate 43 includes a screen support flange 44 extending radially inward from the cylindrical wall 42 upon which the screen 19 is retained. The base plate 43 also includes a trim flange 45 which extends outwardly from the cylindrical wall 42 toward the sidewalls 28 of the body 12. The cylindrical wall 42, trim flange 45 and sidewalls 28 form a pocket 46 open on its lower end between the body 12 and the shroud 18. The pocket 46 is adapted to receive a portion of the bezel 21 as will be described below.

The bezel 21 includes a ceiling flange 47 disposed parallel to the roof 11 on the ceiling side, or lower side, of the roof 11. The ceiling flange 47 is secured to the lower surface of roof 11 by means of fasteners. The bezel 21 includes a second portion comprising a wall 48 which extends substantially perpendicular to the ceiling flange 47 and is telescopically received in the pocket 46 adjacent the side walls 28. The bezel 21 spans the portion of the roof opening below the lower end of the upstanding sidewalls 28 of the body 12 and the ceiling, or lower surface of the roof 11. The telescopic arrangement of the wall 48 in the pocket 46 permits the assembly of the vent 10 to roofs of different thicknesses.

Figure 3:
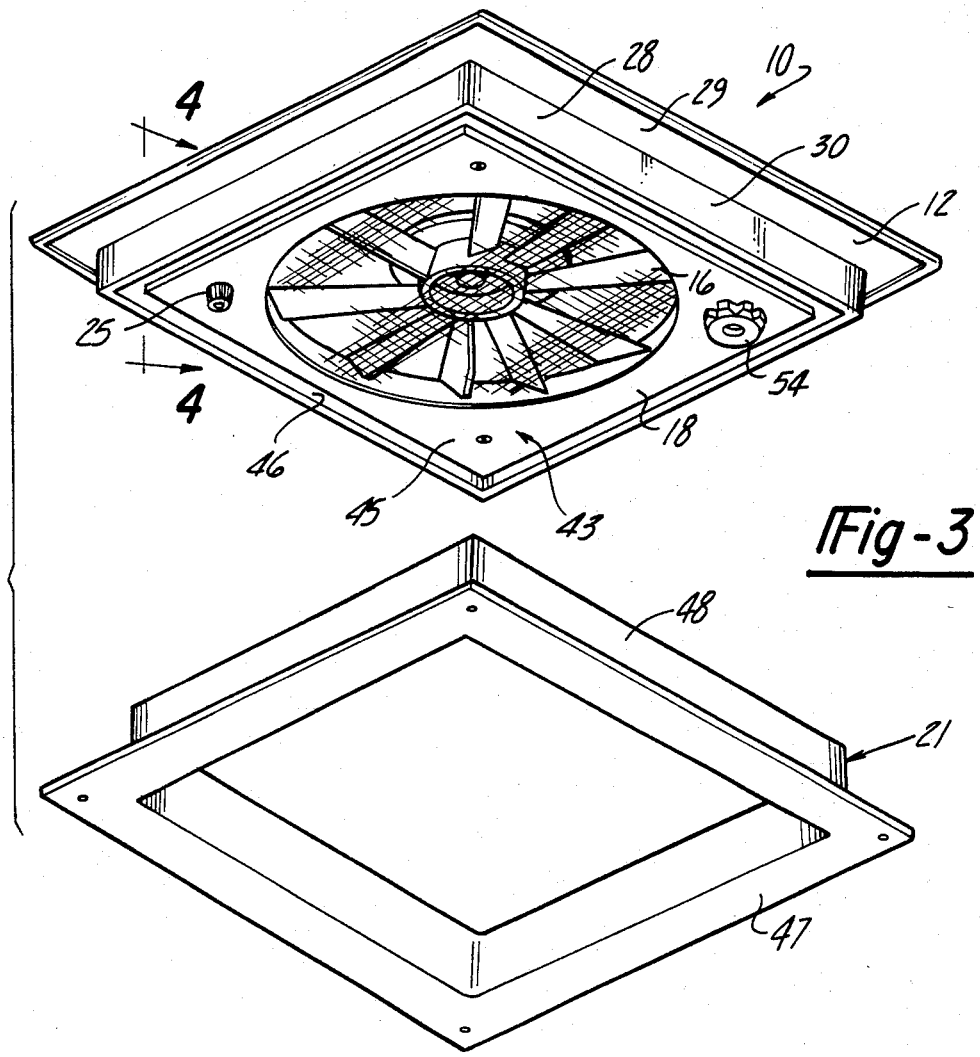
FIG. 3 is an exploded perspective view showing the body and shroud assembly as a unit separate from the bezel.

The cover lifting means 24 is comprised of an elongate arm 50 having one end mounted on the body 12 and its opposite end engaging a flange 51 which is secured to the cover 23 parallel to the arm 50. The flange 51 includes a slot 52 which extends longitudinally in the flange and is adapted to receive a roller 53 which is affixed to said opposite end of the arm 50. The arm 50 is attached to a crank mechanism (not shown) housed within the pocket 46. As shown in FIG. 3, the crank mechanism is manually operated by means of a knob 54 which actuates a worm and pinion gear crank mechanism (not shown) as is well known in the art. The pocket 46 protects the crank mechanism and permits convenient location of the knob 54 on the lower side of the shroud 18.

As shown in FIG. 1, a seal ring 55 is preferably provided on the upper end of the sidewalls 28. The seal ring 55 extends completely about the perimeter of the sidewalls 28 to engage and establish a seal with the cover 23 when the cover is in its closed position. The seal ring 55 is preferably made of a soft, elastomeric material capable of conforming to the closed cover 23.

Referring now to FIG. 4, the switch 25 for turning the motor 15 on and off is shown to include two resistance coils 57 which are adapted to be connected in parallel to the motor 15 for controlling the speed of the motor 15. The resistance coils 57 are externally mounted on the switch to permit heat dissipation. When the switch 25 is in the low or intermediate speed positions, at least one of the coils is connected in parallel with the motor to shunt some of the current through the resistance coil. The current passing through the coil 57 is converted into heat energy that must be dissipated. The switch body including the coil portions thereof is mounted in the pocket 46 to protect the switch and prevent accidental contact with the coils 57 which may become hot. One or more openings 58 and **58*a* are provided in the pocket 46 near the switch 25 to facilitate air flow about the switch 25, thereby increasing heat dissipation and preventing melting or distortion of the plastic parts of the assembly 10 adjacent the switch 25 without adding to the cross-sectional thickness of the assembly. The opening 58 preferably includes a screen 59 which permits ventilation while protecting the switch 25**.

A thermostat (not shown) may also be provided to automatically stop current flow to, or disable, the motor 15 when the temperature in the enclosure falls below a predetermined level. Conversely, the thermostat permits operation of the motor 15 when the temperature in the enclosure exceeds a predetermined level, the cover 23 is open and the switch 25 is turned to the low, intermediate, or high speed position.

The invention may be further developed within the scope of the following claims. Accordingly, the above specification is to be interpreted as being illustrative of one embodiment of the present invention, rather than in a strictly limited sense.

I now claim:

1. A vent fan assembly for a roof comprising:

a body having a plurality of sidewalls extending in one direction and defining a closed polygonal shape, a roof support flange extending perpendicularly to the sidewalls and outwardly from the exterior of the sidewalls between a top end and a bottom end of the sidewalls, a motor mount flange extending perpendicular to the sidewalls and inwardly from the interior of the sidewalls to define a first circular opening;

a shroud having a cylindrical sidewall extending in the same direction as the sidewalls of the body, a base plate secured to a lower end of the cylindrical sidewall having a screen support flange extending in a plane inwardly from the cylindrical sidewall to define a second circular opening, and a trim flange extending outwardly toward the sidewalls of the body to an outer edge adjacent to and spaced from said body sidewalls, said cylindrical sidewall having an upper end adapted to engage the motor mount flange adjacent the first circular opening, said body and shroud defining a pocket between the sidewalls of the body and the cylindrical sidewall of the shroud, the pocket having a downwardly facing opening defined by the outer edge of the trim flange and said sidewalls of the body;

a bezel having a plurality of sidewalls extending in the same direction as said body sidewalls and shaped substantially congruently thereto, said bezel further having a ceiling flange extending outwardly in a direction parallel to said roof support flange from the lower edge of said bezel sidewalls, said bezel walls being telescopically received in the pocket whereby roofs of different thicknesses may be received between the ceiling flange and the roof support flange;

a motor and fan blade secured to the motor mount flange; and an openable cover connected to the body above said motor to selectively close said vent fan assembly.

2. The vent fan assembly of claim 1 wherein the distance between the top end of the body sidewalls and the roof support flange is greater than the distance between the top end of the body sidewalls and the motor mount flange thereby permitting the motor to be mounted above the level of the roof and permitting the motor and fan blade to be recessed into the roof.

3. The vent fan assembly of claim 2 wherein said motor is a disc-type electric motor.

4. The vent fan assembly of claim 1 wherein said motor mount flange includes a H-shaped portion having spaced parallel legs extending across said first circular opening and being interconnected by an attachment ring to which the motor is attached.

5. The vent fan assembly of claim 4 wherein said parallel legs include an upstanding rib for reinforcing the legs and providing vibration dampening.

6. The vent fan assembly of claim 2 wherein a screen is retained on the screen support flange thereby providing a protective guard for the fan at a point spaced upwardly from a lower surface of the roof in which the assembly is mounted.

7. The vent fan assembly of claim 1 wherein a seal ring formed of an elastomeric material is attached to the top end of the body sidewalls to form a seal with the cover when the cover is closed.

8. The vent fan assembly of claim 1 wherein the ceiling flange is adapted to be mounted flush against a lower surface of a ceiling, whereby said ceiling flange defines a plane below which no portion of the vent fan assembly extends.

* * * * *